US007438116B2

(12) United States Patent
Tsuji

(10) Patent No.: US 7,438,116 B2
(45) Date of Patent: Oct. 21, 2008

(54) ALIGNING-POSITIONING MECHANISM AND ALIGNING-POSITIONING METHOD

(75) Inventor: Kazuya Tsuji, Hiroshima (JP)

(73) Assignee: The Japan Works, Ltd., Tokyo (JP)

( * ) Notice: Subject to any disclaimer, the term of this patent is extended or adjusted under 35 U.S.C. 154(b) by 126 days.

(21) Appl. No.: 11/441,019

(22) Filed: May 26, 2006

(65) Prior Publication Data

US 2006/0266494 A1 Nov. 30, 2006

(30) Foreign Application Priority Data

May 26, 2005 (JP) ..... P2005-154119

(51) Int. Cl.
*B22D 17/10* (2006.01)

(52) U.S. Cl. ..... 164/113; 164/312

(58) Field of Classification Search ..... 164/113, 164/312

See application file for complete search history.

(56) References Cited

U.S. PATENT DOCUMENTS 3,936,259 A * 2/1976 Hofer et al. ..... 425/574

FOREIGN PATENT DOCUMENTS

| | | | |
|---|---|---|---|
| JP | 56-93532 | A | 7/1981 |
| JP | 56093532 | A | 7/1981 |
| JP | 2-150793 | A | 6/1990 |
| JP | 2003-94158 | A | 4/2003 |

* cited by examiner

*Primary Examiner*—Kuang Lin
(74) *Attorney, Agent, or Firm*—Sughrue Mion, PLLC

(57) ABSTRACT

A positioning plate of this invention comprises an outer side plate of a torus shape having an outer side plate hole formed eccentrically of the outer circumference, and an inner side plate of a torus shape having such an inner side plate hole eccentrically of the outer circumference that a leading end portion is fitted. The outer side plate is fitted in a stationary die hole, and the inner side plate is fitted in the outer side plate hole of the outer side plate.

6 Claims, 8 Drawing Sheets

ALIGNING-POSITIONING MECHANISM AND ALIGNING-POSITIONING METHOD

This application is based on Japanese Patent Application No. 2005-154119, which is incorporated herein by reference.

BACKGROUND OF THE INVENTION

1. Field of the Invention

The present invention relates to an aligning-positioning mechanism and an aligning-positioning method for positioning a pipe or a shaft to be arranged in a circular hole.

2. Description of the Related Art

In the related art, there are many mechanical parts, which need positioning of a pipe or a shaft in a circular hole. FIG. 5 is a schematic top plan view showing the state, in which a pipe 112 of a circular section is concentrically positioned in a circular hole 111 formed in a block 110 and in which a plate 113 is fitted without any clearance from the hole 111 and the pipe 112 in a space of a torus shape formed by the hole 111 and the pipe 112.

This constitution is disclosed in JP-A-2003-94158 as such a nozzle device, for example, in a metallic injection molding machine as minimizes the unnecessary portions other than the product thereby to lower the cost for the metal machining. FIG. 6 is a schematic section showing one example of the metallic injection molding machine of the related art having the constitution of FIG. 5.

The metallic injection molding machine includes a heating cylinder 202 having a heater 221 disposed on its outer circumference portion, and an extended nozzle 203, which is mounted on the leading end of the heating cylinder 202 and which can be inserted into the mold. A positioning plate 241 is fitted in a hole 243 formed in a stationary mold 204. The leading end portion 232 of the extended nozzle 203 is fitted in the positioning plate 241 fitted in that hole 243.

The leading end portion 232 of the extended nozzle 203 is inserted in the hole formed by the positioning plate 241, and the outer circumference clearance of the leading end portion 232 is sealed up due to the thermal expansion difference between the positioning plate 241 and the leading end portion 232 thereby to prevent the outflow and burst of molten metal.

Against a taper portion 242 formed at the stationary die 204, there abuts a taper portion 231, which is formed at an intermediate portion of the extended nozzle 203 thereby to receive the touching force of the metallic injection molding machine.

Moreover, the positioning plate 241 is mounted on the stationary die 204 from the side of a movable die of the stationary die 204, on which a product ejecting mechanism 251 is disposed.

In this constitution, it has to be avoided with a view to preventing the outflow and burst of the molten metal that a clearance more than that for the smooth fitting is formed either between the stationary die 204 and the positioning plate 241 or between the positioning plate 241 and the leading end portion 232 of the extended nozzle 203. On the other hand, the shape of the positioning plate 241 is seriously influenced by the relative positions of the hole 243 and the leading end portion 232.

Here: the hole 243 of FIG. 6 corresponds to the hole 111 in FIG. 5; the leading end portion 232 of FIG. 6 corresponds to the pipe 112 in FIG. 5; and the positioning plate 241 of FIG. 6 corresponds to the plate 113 in FIG. 5.

In the constitution thus far described, the shape of the positioning plate 241 is influenced by the relative positions of the hole 243 and the leading end portion 232. In order to avoid preparations of a plurality of positioning plates 241 for the individual eccentricities of the leading end portion 232 from the hole 243, therefore, it is preferred that the leading end portion 232 is completely concentric to the hole 243.

In the metallic injection molding machine, however, due to errors at the time of assembling the heating cylinder 202 or due to the curvature of the heating cylinder 202 by the thermal stress to be caused by the circumferential temperature difference of the heating cylinder 202, more or less misalignment occurs on the center of the leading end portion 232 of the extended nozzle 203 mounted on the leading end of the heating cylinder 202. Therefore, the metallic injection molding machine is usually equipped with the nozzle aligning mechanism, which is mostly intended to adjust the deviation at the unit of several millimeters. On the other hand, the maximum clearance permitted to prevent the intrusion of the molten metal from the clearance between the leading end portion 232 and the positioning plate 241 is several tens micrometers. In other words, it is seriously difficult to align the leading end portion 232 and the hole 243 so that the molten metal may be prevented from intruding into the clearance between the leading end portion 232 and the positioning plate 241 by using the ordinary nozzle aligning mechanism.

Therefore, the positioning for making concentric the hole 243 to be fitted on the outer circumference of the positioning plate 241 of the stationary die 204 and the leading end portion 232 of the extended nozzle 203 is performed by fitting between the taper portion 231 formed at the intermediate portion of the extended nozzle 203 and the taper portion 242 formed at the stationary die 204. This makes it necessary to work the taper portion 231 on the side of the extended nozzle 203 and the taper portion 242 on the side of the stationary die 204 extremely precisely. A high sizing precision is also required on the components from the individual taper portions 231 and 242 to the fitting portion between the leading end portion 232 and the positioning plate 241. These being considered, however, it is seriously difficult and not practical to keep the concentricity between the hole 243 and the leading end portion 232 always within a range of several ten micrometers.

As countermeasures, there has been adopted a method for enlarging the clearance between the hole 243 of the stationary die 204 and the outer circumference of the positioning plate 241. By mounting the positioning plate 241 in the hole 243 of the stationary die 204 with an offset of the eccentricity of the leading end portion 232, more specifically, the positioning plate 241 and the leading end portion 232 are fitted.

According to this method, however, there is established between the stationary die 204 and the positioning plate 241 a clearance which is the sum of the inherent clearance and the eccentricity of the leading end portion 232 from the hole 243. Therefore, the molten metal does not flow out to the outside of the die but intrudes into the clearance between the stationary die 204 and the positioning plate 241. As a result, the positioning plate 241 cannot be disassembled from the stationary die 204, or a molding 206 may be left in the stationary die 204 when the die is opened during the molding operation.

In order to avoid the troubles due to the intrusion of the molten metal, the constitution is modified, as shown in FIG. 7, such that the taper portion 231 formed at the intermediate portion of the extended nozzle 203 is made of a bushing 233 different from the extended nozzle 203 thereby to form a clearance between the bushing 233 and the extended nozzle 203. Alternatively, the constitution is modified, as shown in FIG. 8, such that a contacting portion 250 between the intermediate portion of the extended nozzle 203 and the stationary die 204 is formed into a vertically abutting shape so that the alignment may be done by the aforementioned nozzle aligning mechanism. However, this adjusting work is difficult, as has been described hereinbefore, and the working time period for preparing the run may be long.

SUMMARY OF THE INVENTION

Therefore, the present invention has an object to provide an aligning-positioning mechanism and an aligning-positioning method, which can finely adjust the positioning of a pipe or a shaft to be arranged in a circular hole, with ease.

In order to achieve the aforementioned object, according to the invention, there is provided an aligning-positioning mechanism comprising a positioning member arranged between a circular hole and a pipe or a shaft for positioning the pipe or the shaft in the hole, the positioning member comprising a torus member divided into a plurality and each having a torus shape in which an inner circumference thereof eccentrics with respect to an outer circumference thereof, wherein an outer circumference of an outermost torus member is fitted in the hole, and wherein an outer circumference of the pipe or the shaft is fitted in an inner circumference of an innermost torus member.

As described above, the positioning member is divided into plural ones, and the individual torus members have their inner circumferences made eccentric with respect to the outer circumference. By adjusting the angle of the eccentric directions between the individual torus members and the directions, therefore, it is possible to adjust the positions of the inner circumferences of the torus members, in which the pipe or the shaft is fitted. In short, the aligning-positioning mechanism of the invention can adjust the hole positions, in which the pipe or the shaft is fitted, with respect to the circular hole so that it can have an easy fine adjustment.

In the aligning-positioning mechanism of the invention, the positioning member may have its divided faces formed in a taper shape.

According to the invention, there is provided an aligning-positioning method, which uses the aligning-positioning mechanism of the invention, comprising adjusting an eccentricity of a center of the inner circumference of the innermost torus member to a center of the hole by adjusting the angle made by the eccentric direction between the individual torus members, and adjusting an eccentric direction by turning the individual torus members.

According to the invention, there is provided an aligning-positioning mechanism including a stationary type positioning plate, comprising an outer side plate having a torus shape in which an outer side plate hole formed eccentrically of the outer circumference thereof, and an inner side plate having a torus shape in which an inner side plate hole, into which a leading end portion of an extended nozzle mounted on a cylinder leading end portion of a metallic injection molding machine is fitted, is formed eccentrically of the outer circumference thereof, wherein the outer side plate is fitted in a stationary die hole formed in a stationary die, and wherein the inner side plate is fitted in the outer side plate hole of the outer side plate.

In the aligning-positioning mechanism of the invention, as described above, the positioning plate includes the two plates of the outer side plate and the inner side plate of the torus shape, and the individual plates have eccentric holes. Moreover, the outer side plate is fitted in the stationary die hole, and the inner side plate is fitted in the outer side plate hole. According to the turning angles of the individual plates, therefore, the hole position of the inner side plate hole, in which the leading end portion of the extended nozzle is fitted, can be finely adjusted with ease with reference to the stationary die hole. Moreover, the constitution does not need such a clearance between the stationary die hole and the positioning plate as matches the eccentricity of the leading end portion of the extended nozzle with respect to the stationary die hole, so that the molten metal will not intrude into the clearance. Moreover, the individual plates are fitted without the clearance for permitting the molten metal to intrude, so that the molten metal will not intrude between the individual plates.

According to the invention, as has been described hereinbefore, the hole positions to fit the pipe or the shaft are adjusted by adjusting the angles made by the eccentric directions of the plural eccentric torus members and the eccentric directions, so that their fine adjustments are facilitated.

In the positioning plate of the invention, moreover, the molten metal does not intrude between the stationary die hole and the positioning plate so that the hole position of the inner plate hole, in which the leading end portion is fitted, can be finely adjusted with ease with respect to the stationary die hole.

DETAILED DESCRIPTION OF THE PREFERRED EMBODIMENTS

An embodiment of the invention is described in the following with reference to the accompanying drawings.

Figure 1:
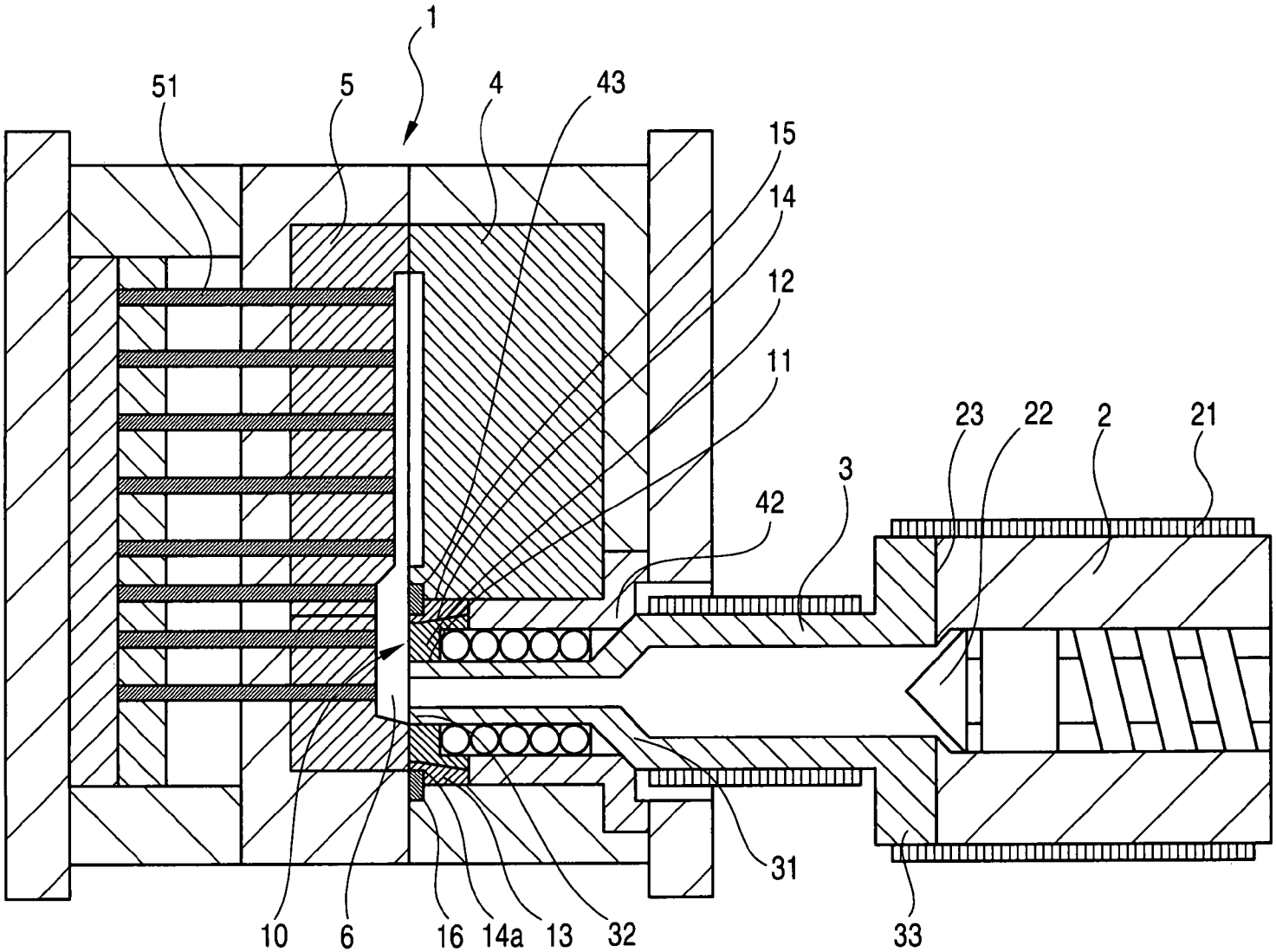
FIG. 1 is a side section view showing a constitution of a metallic injection molding machine and a stationary die, to which one embodiment of the invention is applied.

FIG. 1 is a side section showing a constitution of a metallic injection molding machine and a stationary die, to which one embodiment of the invention is applied.

[Metallic Injection Molding Machine]

The metallic injection molding machine includes: a heating cylinder 2 having a heater 21 disposed on its outer circumference; an extended nozzle 3 mounted on the leading end portion 23 of the cylinder such that it can be inserted into the die; and a screw 22 rotatably housed in the heating cylinder 2. The extended nozzle 3 is composed of: a leading end portion 32 fitted in an inner side plate hole 11 of a later-described inner side plate 12; a mounted end 33 mounted in abutment on the cylinder leading end portion 23; and a taper portion 31 formed between the leading end portion 32 and the mounted end 33.

[Die]

The die 1 is composed of a stationary die 4 having a stationary die hole 15 formed therein, and a movable die 5 made movable relative to the stationary die 4. In the stationary die hole 15 of the stationary die 4, there are fitted a positioning plate 10 which has the inner side plate 12 and an outer side plate 13, and a stationary die side taper portion 42, which is tapered at a position matching the taper portion 31 of the extended nozzle 3. The positioning plate 10 is fitted in the stationary die hole 15 on the side of the movable die 5, and the stationary die side taper portion 42 is fitted on the side, into which the extended nozzle 3 of the stationary die hole 15 proceeds. The end portion of the positioning plate 10 and the end portion of the stationary die side taper portion 42 abut against each other in the stationary die hole 15. On the side of the stationary die hole 15 to face the movable die 5, on the other hand, there is formed a stepped portion 43, on which is fitted a holding plate 16 for holding the positioning plate 10.

The movable die 5 is provided with an ejecting mechanism 51 for ejecting a molding 6 prepared.

[Positioning Plate]

Figure 2:
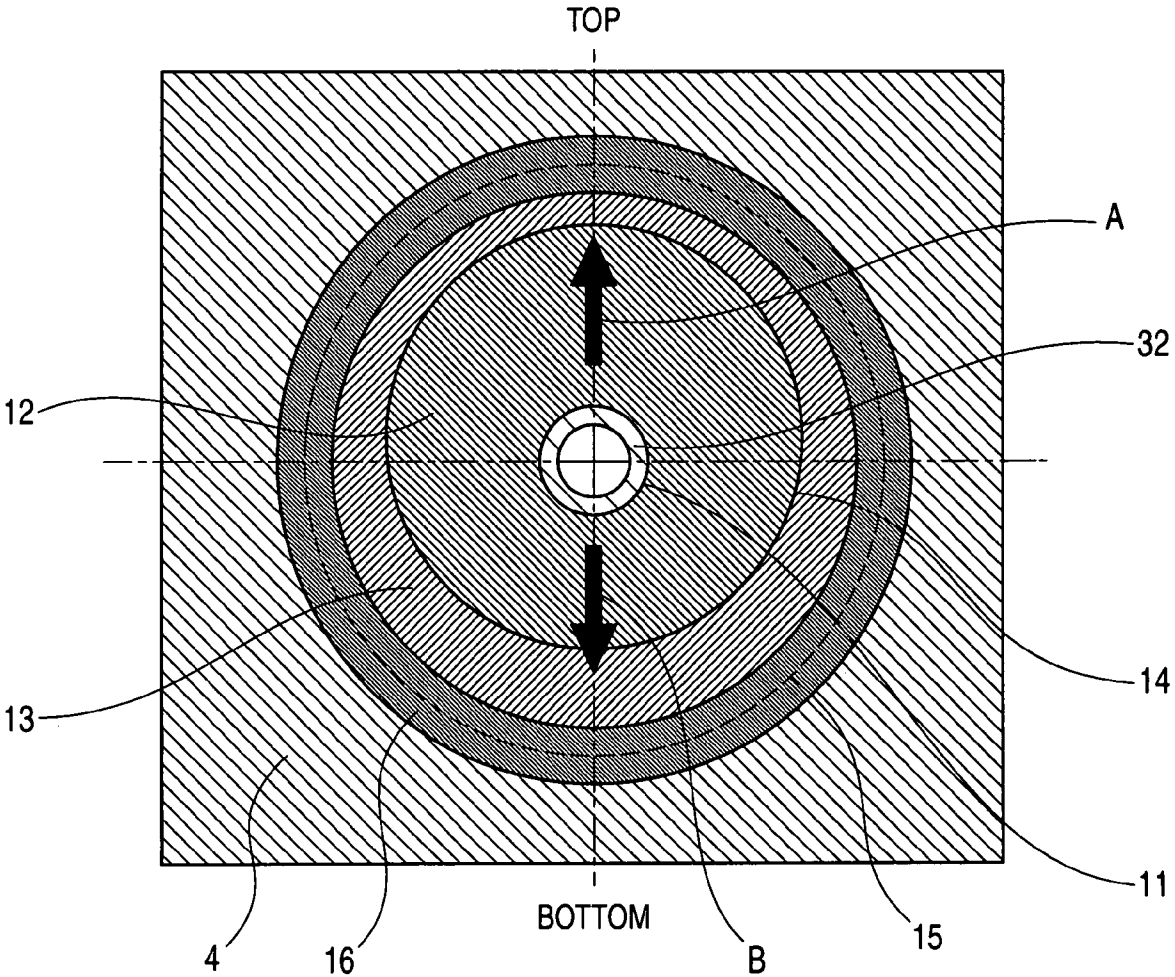
FIG. 2 is a partially enlarged view, as seen from the side of the movable die, of a positioning plate mounted on the stationary die, and a top plan view for explaining the fitting of the positioning plate of the case, in which the leading end portion of an extended nozzle and a stationary die hole are made concentric.

FIG. 2 is a partially enlarged view, as taken from the side of the movable die, of the positioning plate mounted on the stationary die.

The positioning plate 10 includes the outer side plate 13 and the inner side plate 12, the latter of which is fitted in an outer side plate hole 14 formed in the outer side plate 13. In other words, the positioning plate 10 is radially divided into the outer side plate 13 and the inner side plate 12.

The outer side plate 13 has a shape of an annulus ring, i.e., a torus shape, and the outer side plate hole 14 forming the hole portion is made eccentric, in this embodiment, by 1 mm with respect to the outer circumferential portion of the outer side plate 13.

Moreover, the outer side plate hole 14 has a taper face formed to expand toward the inside of the stationary die hole 15, when the outer side plate 13 is mounted in the stationary die hole 15. Specifically, the taper face of the outer side plate hole 14 is directed in such a direction that the inner side plate 12 to be fitted therein is pushed onto the stationary die side taper portion 42. In other words, while the outer side plate is being mounted in the stationary die hole 15, the outer side plate hole 14 is arranged at its radially smaller side on the side of the movable die 5 and at its radially larger side on the stationary die side taper portion 42.

On the radially smaller side of the outer side plate hole 14 of the outer side plate 13, moreover, there is formed a receiving portion 14*a* for mounting the holding plate 16.

The inner side plate 12 also has a torus shape like the outer side plate 13, and the inner side plate hole 11 for the hole portion is made eccentric, in this embodiment, by 1 mm with respect to the outer circumferential portion of the inner side plate 12. The inner side plate hole 11 made eccentric has a straight shape, in which the leading end portion 32 of the extended nozzle 3 is fitted. On the other hand, the outer circumferential portion of the inner side plate 12 is formed into a taper face. Specifically, the inner side plate 12 is fitted, when used, in the outer side plate hole 14 so that it has a taper face matching the taper face of the outer side plate hole 14.

The outer circumference of the outer side plate 13 is so closely fitted in the stationary die hole 15 as to have no clearance permitting intrusion of molten metal. Therefore, this molten metal will not intrude between the outer side plate 13 and the stationary die hole 15.

Moreover, the inner side plate 12 is also fitted in the outer side plate hole 14 of the outer side plate 13 so that the molten metal will not intrude between the inner side plate 12 and the outer side plate 13.

As will be described hereinafter, moreover, the leading end portion 32 of the extended nozzle 3 is fitted in the inner side plate hole 11 of the inner side plate 12 so that the molten metal will not intrude between the leading end portion 32 and the inner side plate 12.

[Fittings of Stationary Die, Outer Side Plate and Inner Side Plate]

In the positioning plate 10 of this embodiment, the outer side plate hole 14 of the outer side plate 13 and the inner side plate hole 11 of the inner side plate 12 are individually made eccentric. According to the manner to make the fittings in the stationary die hole 15, therefore, the position of the inner side plate hole 11 can be changed and adjusted relative to the leading end portion 32 of the extended nozzle 3.

Figure 3:
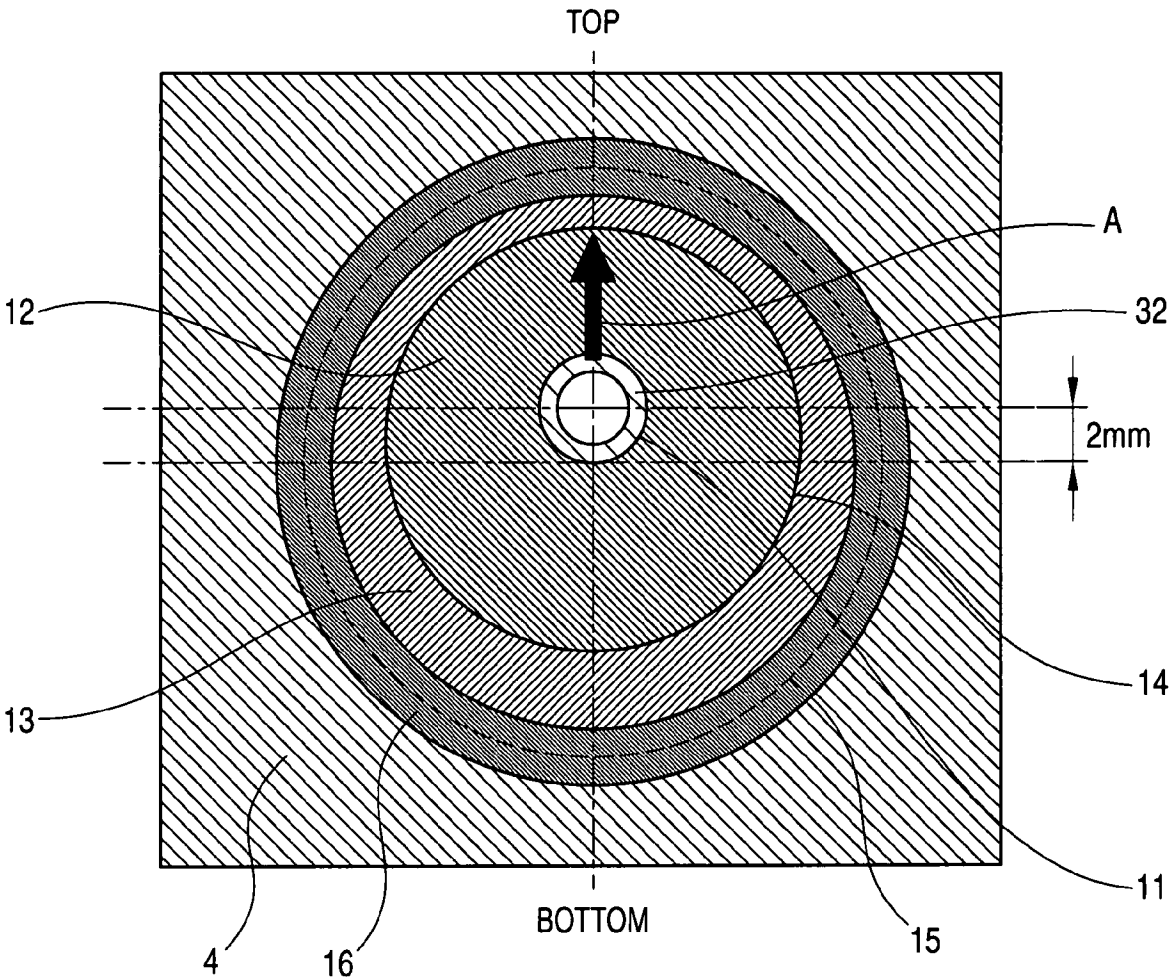
FIG. 3 is a top plan view for explaining the fitting of the positioning plate of the case, in which the center position of the leading end portion of the extended nozzle is eccentric toward the top by 2 mm from the center position of the stationary die hole.
Figure 4:
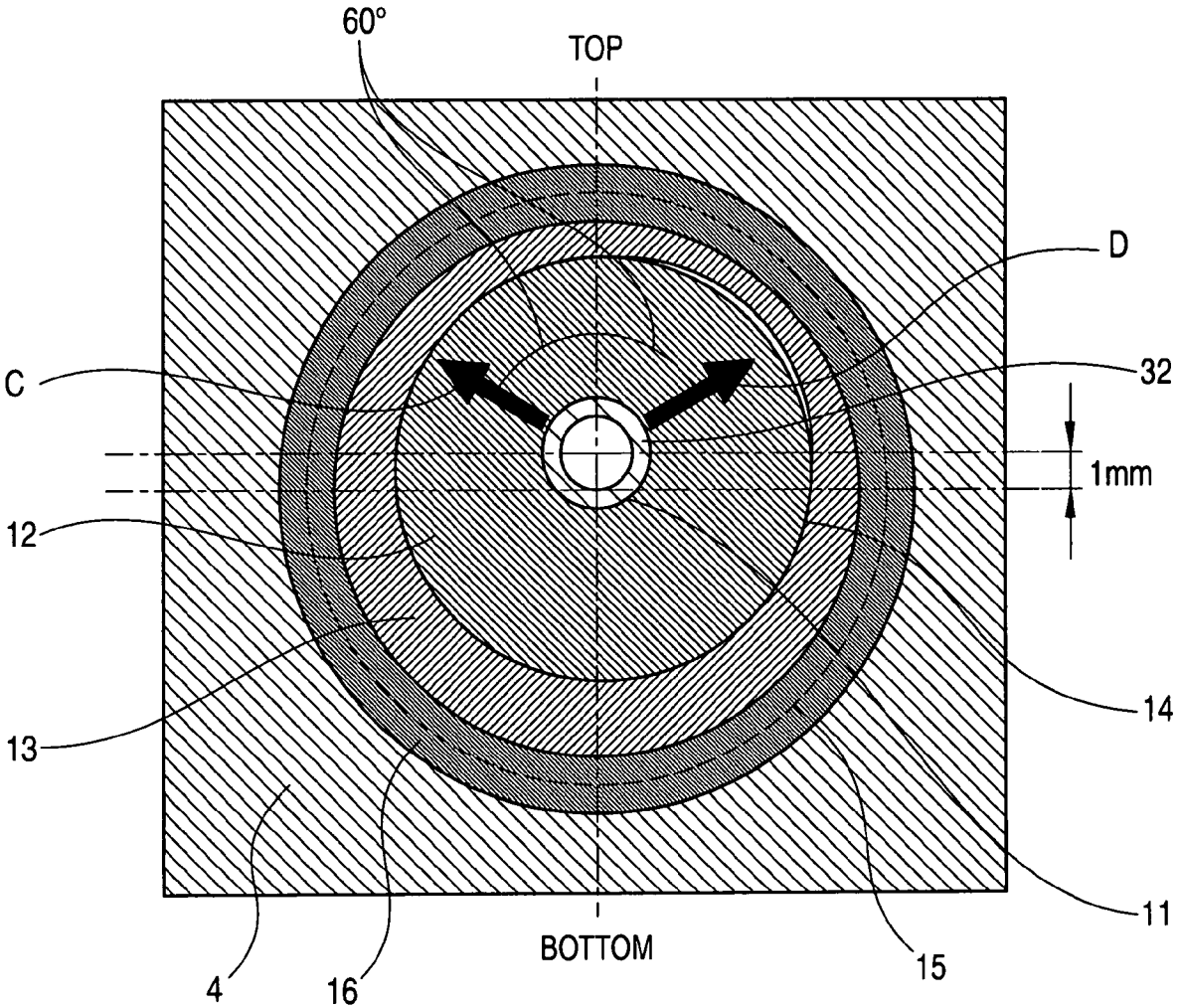
FIG. 4 is a top plan view for explaining the fitting of the positioning plate of the case, in which the center position of the leading end portion of the extended nozzle is eccentric toward the top by 1 mm from the center position of the stationary die hole.
Figure 5:
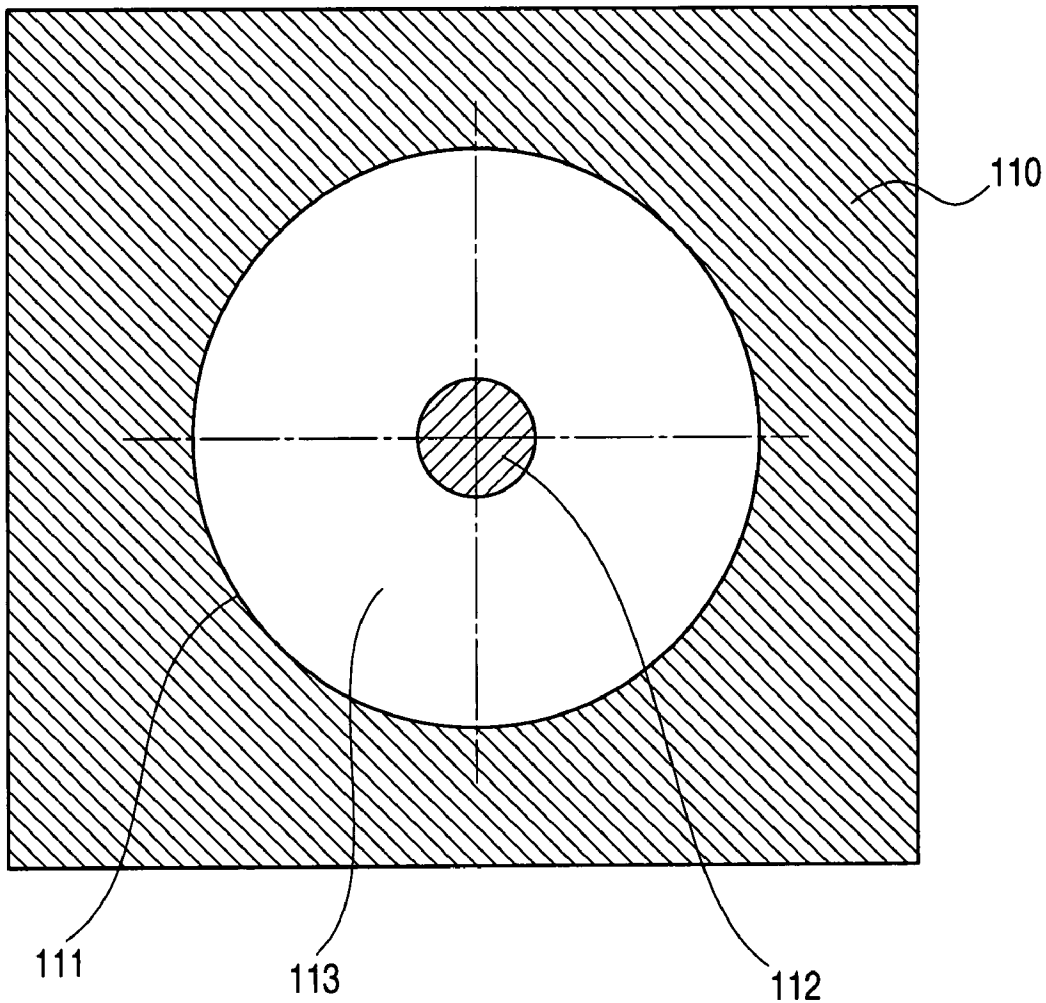
FIG. 5 is a schematic top plan view showing a constitution, in which a shaft is arranged on a concentric circle in a circular hole and in which the plate is fitted in a space of a torus shape formed of the hole and the shaft.
Figure 6:
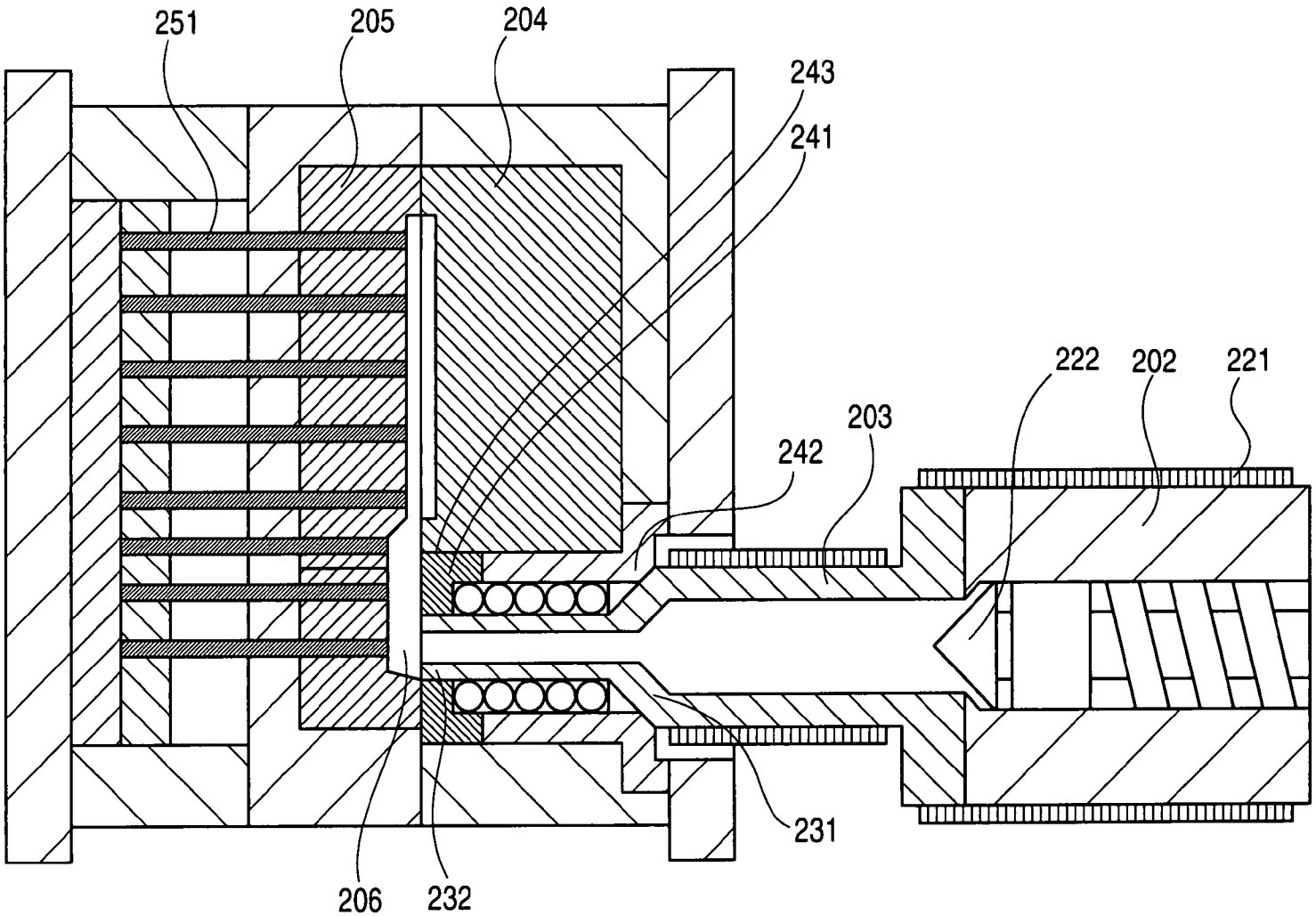
FIG. 6 is a schematic section of one example of a metallic injection molding machine of the related art having the constitution shown in FIG. 5.
Figure 7:
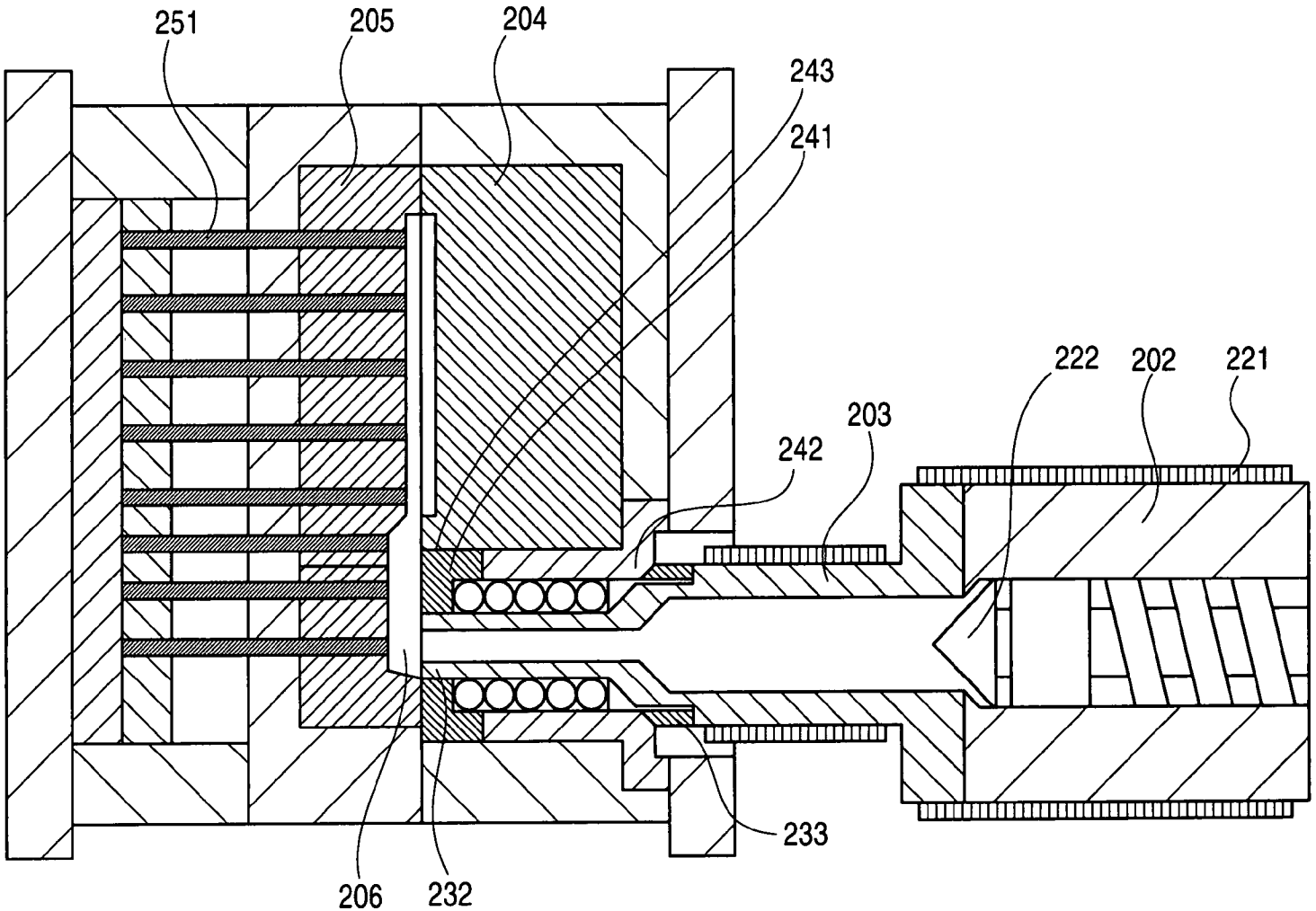
FIG. 7 is a schematic section of one example of the metallic injection molding machine of the related art, in which the concentric adjustment is made with a nozzle aligning mechanism by forming a clearance between a bushing and an extended nozzle.
Figure 8:
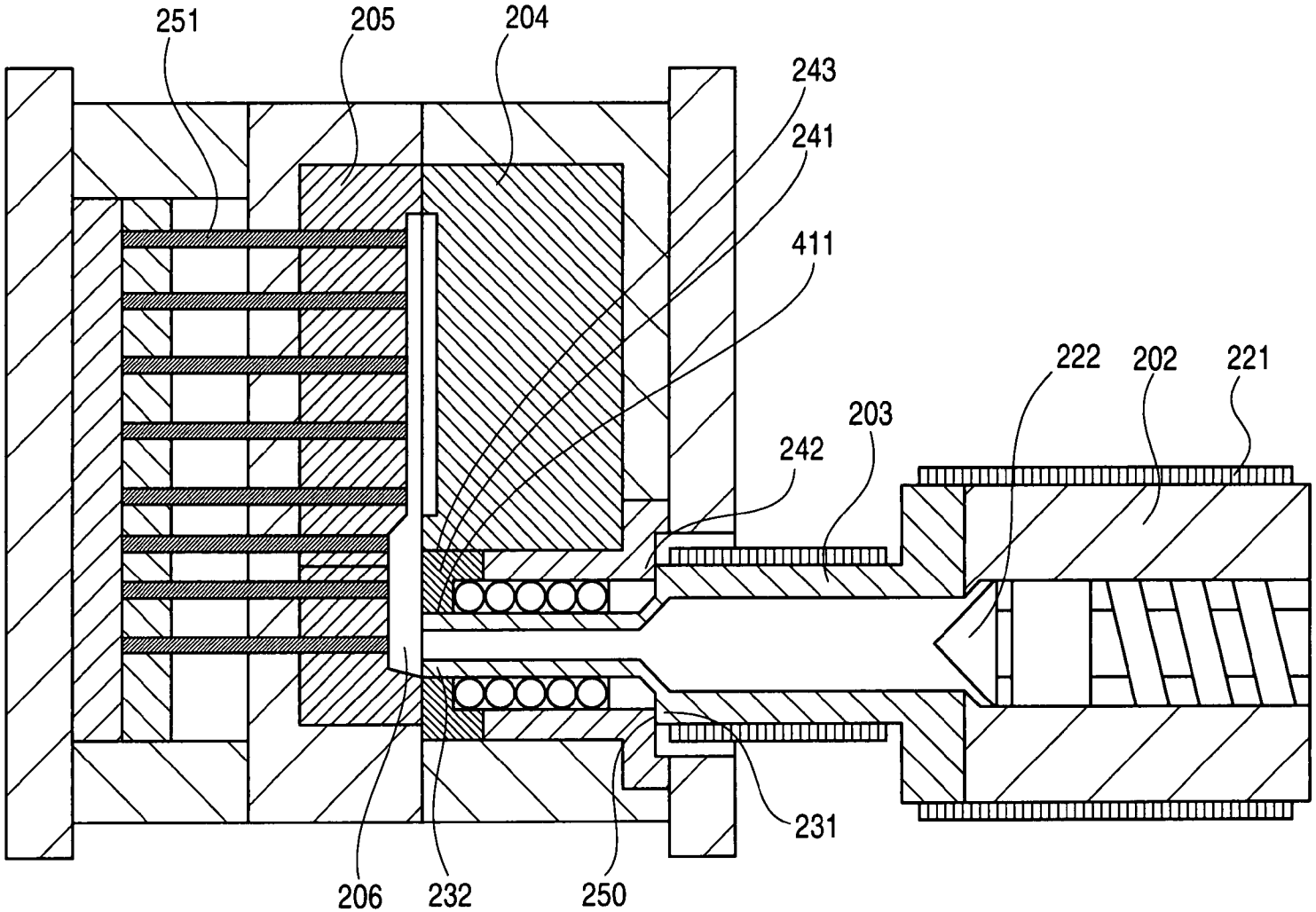
FIG. 8 is a schematic section of one example of the metallic injection molding machine of the related art, in which the concentric adjustment is made with a nozzle aligning mechanism by forming the stationary die and the extended nozzle into a vertically abutting shape.

The manners to fit the positioning plate 10 in the stationary die 4 will be described with reference to FIG. 2 to FIG. 4. Of FIG. 2 to FIG. 4 presenting partially enlarged views, as seen from the side of the movable die, of the positioning plate mounted on the stationary die: FIG. 2 shows the case, in which the leading end portion of the extended nozzle and the stationary die hole are made concentric; FIG. 3 shows the case, in which the center positions are made eccentric by 2 mm toward the top; and FIG. 4 shows the case, in which the center positions are made eccentric by 1 mm toward the top. Here in FIG. 2 to FIG. 4, the "top" indicates the direction toward the top at the time when the metallic injection molding machine is installed, and the "bottom" indicates the direction toward the face of installation, i.e., toward the ground.

At first, the fitting case, in which the leading end portion 32 of the extended nozzle 3 and the stationary die hole 15 are concentric, is described with reference to FIG. 2. In this case, the outer side plate 13 is so fitted in the stationary die hole 15 that the eccentricity of the outer side plate hole 14 with respect to the stationary die hole 15 is directed in the direction of arrow A (toward the top). Moreover, the inner side plate 12 is so fitted in the outer side plate hole 14 in this state that the eccentricity is directed in the direction of arrow B (toward the bottom, i.e., in the opposite direction to arrow A). Since the outer side plate hole 14 and the inner side plate 12 are thus fitted with their eccentric directions being deviation by 180 degrees, the inner side plate core 11 is concentric to the stationary die hole 15. As a result, the leading end portion 32 of the extended nozzle 3 can be fitted without any clearance in the inner side plate hole 11 thereby to prevent the molten metal from intruding between the leading end portion 32 and the inner side plate 12.

Next, the fitting case, in which the leading end portion 32 of the extended nozzle 3 and the stationary die hole 15 are eccentric by 2 mm toward the top, is described with reference to FIG. 3. In this case, the outer side plate 13 is so fitted in the stationary die hole 15 that the eccentricity of the outer side plate hole 14 with respect to the stationary die hole 15 is directed in the direction of the arrow A. Moreover, the inner side plate 12 is so fitted in the outer side plate hole 14 in this state that the eccentricity is also directed in the same direction of the arrow A. Since both the outer side plate hole 14 and the inner side plate 12 are thus fitted in the same direction toward the top, the inner side plate core 11 becomes eccentric by 2 mm from the stationary die hole 15. As a result, the leading end portion 32 of the extended nozzle 3 can be fitted without any clearance in the inner side plate hole 11.

Next, the fitting case, in which the leading end portion 32 of the extended nozzle 3 and the stationary die hole 15 are eccentric by 1 mm toward the top, is described with reference to FIG. 4. In this case, the outer side plate 13 is so fitted in the stationary die hole 15 that the eccentricity of the outer side plate hole 14 with respect to the stationary die hole 15 is directed in the direction of arrow D turned clockwise by 60 degrees from the top direction. Moreover, the inner side plate 12 is so fitted in the outer side plate hole 14 in this state that the eccentricity is directed in the direction of arrow C turned counter-clockwise by 60 degrees from the top direction. As shown in FIG. 4, the eccentric positions of the individual holes 11 and 14 are individually displaced symmetrically of each other by 60 degrees so that the inner side plate core 11 becomes eccentric by 2 mm from the stationary die hole 15. As a result, the leading end portion 32 of the extended nozzle 3 can be fitted without any clearance in the inner side plate hole 11.

Here, it is needless to say that the invention should not be limited to the combination example of the eccentric directions of the outer side plate hole 14 and the inner side plate hole 11, as has been described with reference to FIG. 2 to FIG. 4. Specifically, if the eccentric directions of the individual inner side plate hole 11 and the outer side plate hole 14 are changed according to the eccentric extents and directions of the leading end portion 32 of the extended nozzle 3 and the stationary die hole 15, the leading end portion 32 of the extended nozzle 3 can be fitted without any clearance between the stationary die hole 15 and the positioning plate 10.

Moreover, the eccentricities of the holes formed in the individual plates have been individually described to be 1 mm in the embodiment. However, the eccentricities should not be limited thereto but may be less than 1 mm, or 1 mm or more. If less than 1 mm, it is easy to finely adjust the eccentric extents and directions. In case the eccentricity is 1 mm or more, on the other hand, it is possible to easily cope with the case, in which the eccentricity is large.

Moreover, the individual holes should not have any equal eccentricity but may have different eccentricities.

In this embodiment, moreover, the positioning plate 10 is divided into two plates of the outer side plate 13 and the inner side plate 12. However, the invention should not be limited thereto, but the positioning plate may be divided into three or more.

As has been described hereinbefore, the positioning plate 10 of this embodiment is composed of the plural torus plates having the eccentric holes formed therein. Specifically, the outer side plate 13 having the outer side plate hole 14 eccentrically formed is fitted in the stationary die hole 15, and the inner side plate 12 having the inner side plate hole 11 eccentrically formed is fitted in the outer side plate hole 14. Even in case, therefore, the leading end portion 32 of the extended nozzle 3 mounted on the leading end of the heating cylinder 2 is eccentric from the stationary die hole 15 of the stationary die 4, the position of the inner side plate hole 11 for fitting the leading end portion 32 can be finely adjusted with ease with respect to the stationary die hole 15 by adjusting the angle and the direction between the eccentric directions between the individual plates 12 and 13. Unlike the constitution, in which the clearance is formed, by the eccentricity of the leading end portion from the stationary die hole, between the stationary die hole and the positioning plate, the molten metal will not intrude into the clearance.

What is claimed is:

1. An aligning-positioning method comprising:

preparing a stationary type positioning plate, the positioning plate comprising:

an outer side plate having a torus shape in which an outer side plate hole is formed eccentrically of the outer circumference thereof; and an inner side plate having a torus shape in which an inner side plate hole, into which a leading end portion of an extended nozzle mounted on a cylinder leading end portion of a metallic injection molding machine is fitted, is formed eccentrically of the outer circumference thereof;

fitting the outer side plate in a stationary die hole formed in a stationary die;

fitting the inner side plate in the outer side plate hole of the outer side plate so that there is no clearance between the inner and outer side plate through which a fluid can pass;

adjusting an eccentricity of a center of the inner circumference of the inner side plate to a center of the stationary die hole by adjusting the angle made by the eccentric direction between the inner and outer side plates; and adjusting an eccentric direction by turning the inner and outer side plates.

2. The aligning-positioning method according to claim 1, wherein the adjusting the eccentricity of a center of the inner circumference of the inner side plate comprises adjusting each eccentric direction of the inner and outer side plates based on the adjusting the eccentricity of the center of the inner circumference of the inner side plate to the center of the stationary die hole to match the center of the inner circumference of the inner side plate to the center of the stationary die hole, and wherein the adjusting the eccentric direction comprises turning an eccentric direction of the inner and outer side plates by the adjusted eccentric direction and fitting the inner and outer side plates in the stationary die hole in an order from the outer side plate toward the inner side plate.

3. The aligning-positioning method according to claim 1, further comprising:

fitting the outer side plate in the stationary die hole formed in the stationary die as to have no clearance permitting intrusion of molten metal; and fitting the inner side plate in the outer side plate hole of the outer side plate so that the molten metal will not intrude between the inner side plate and the outer side plate.

4. An aligning-positioning mechanism including a stationary type positioning plate, the positioning plate comprising:

an outer side plate having a torus shape in which an outer side plate hole is formed eccentrically of the outer circumference thereof; and an inner side plate having a torus shape in which an inner side plate hole, into which a leading end portion of an extended nozzle mounted on a cylinder leading end portion of a metallic injection molding machine is fitted, is formed eccentrically of the outer circumference thereof, wherein the outer side plate is fitted in a stationary die hole formed in a stationary die, wherein the inner side plate is fitted in the outer side plate hole of the outer side plate, and wherein there is no clearance between the inner and outer side plates through which a fluid can pass.

5. The aligning-positioning mechanism according to claim 4, wherein the outer side plate is fitted in the stationary die hole formed in the stationary die as to have no clearance permitting intrusion of molten metal, and wherein the inner side plate is fitted in the outer side plate hole of the outer side plate so that the molten metal will not intrude between the inner side plate and the outer side plate.

6. An aligning-positioning method comprising:

preparing a stationary type positioning plate, the positioning plate comprising:

an outer side plate having a torus shape in which an outer side plate hole is formed eccentrically of the outer circumference thereof; and an inner side plate having a torus shape in which an inner side plate hole, into which a leading end portion of an extended nozzle mounted on a cylinder leading end portion of a metallic injection molding machine is fitted, is formed eccentrically of the outer circumference thereof;

fitting the outer side plate in a stationary die hole formed in a stationary die;

fitting the inner side plate in the outer side plate hole of the outer side plate so that there is no clearance between the inner and outer side plates through which a fluid can pass;

adjusting each eccentric direction of the outer and inner side plate based on an eccentricity of a center of the inner circumference of the inner side plate to a center of the stationary die hole to match the center of the inner circumference of the inner side plate to the center of the stationary die hole; and wherein the outer circumferential surface of the outer side plate is in direct contact with the stationary die hole, wherein the outer circumferential surface of the nozzle is in direct contact with the inner circumferential surface of the inner side plate, and wherein there is no clearance between the inner and outer side plates through which a fluid can pass.

* * * * *

UNITED STATES PATENT AND TRADEMARK OFFICE

CERTIFICATE OF CORRECTION

PATENT NO. : 7,438,116 B2
APPLICATION NO. : 11/441019
DATED : October 21, 2008
INVENTOR(S) : Kazuya Tsuji It is certified that error appears in the above-identified patent and that said Letters Patent is hereby corrected as shown below:

Title Page; should read;

(73) Assignee: The Japan Steel Works, Ltd., Tokyo, (JP)

Signed and Sealed this

Seventeenth Day of February, 2009

JOHN DOLL
*Acting Director of the United States Patent and Trademark Office*